United States Patent [19]

Schoener et al.

[11] Patent Number: 4,786,336

[45] Date of Patent: Nov. 22, 1988

[54] LOW TEMPERATURE SEAL FOR ANODIZED ALUMINUM SURFACES

[75] Inventors: Glenn C. Schoener, Chalfont; Susan V. Hess, Telford; Anthony J. Malloy, Willow Grove, all of Pa.; Jayne P. Wicklund, Morro Bay, Calif.

[73] Assignee: Amchem Products, Inc., Ambler, Pa.

[21] Appl. No.: 831,723

[22] Filed: Feb. 25, 1986

Related U.S. Application Data

[63] Continuation-in-part of Ser. No. 709,635, Mar. 8, 1985, abandoned.

[51] Int. Cl.[4] ..... C23C 22/34; C23C 22/56

[52] U.S. Cl. ..... 148/6.27; 204/37.6

[58] Field of Search ..... 148/6.27; 204/37.6

[56] References Cited

U.S. PATENT DOCUMENTS 4,148,670 3/1979 Kelly ..... 148/6.27

FOREIGN PATENT DOCUMENTS 150403 9/1982 India .

4023086 6/1974 Japan ..... 204/37.6

*Primary Examiner*—Sam Silverberg

*Attorney, Agent, or Firm*—Alexis Barron

[57] ABSTRACT

This invention relates to a process for sealing an anodized aluminum surface by contacting the surface with an aqueous acidic sealing solution having dissolved therein zirconium and/or titanium and dissolved fluoride, said solution preferably including dissolved silicate and/or a dissolved thiourea compound, and including optionally a sealing auxiliary, the process being carried out at a temperature of no greater than about 40° C.

29 Claims, No Drawings

LOW TEMPERATURE SEAL FOR ANODIZED ALUMINUM SURFACES

CROSS-REFERENCE TO RELATED APPLICATION

This is a continuation-in-part of application Ser. No. 709,635, filed Mar. 8, 1985, now abandoned.

FIELD OF THE INVENTION

This invention relates to the sealing of anodized aluminum surfaces which are corrosion resistant, and particularly well-suited for exterior applications such as decorative and structural building components. More specifically, this invention relates to low-temperature, aqueous acidic sealing solutions which seal anodized aluminum surfaces and which do not require the use of materials such as nickel which may create problems of waste disposal or the need to use relatively high temperatures in the application of the sealing solutions.

REPORTED DEVELOPMENTS

Anodized aluminum is customarily sealed after anodizing in a low-temperature sealing process which employs one of a variety of known sealing salts. In particular, a nickel salt is often currently employed, usually nickel fluoride. According to generally accepted theory, sealing of the anodized aluminum by the nickel fluoride salt process is accomplished by deposition of a complex nickel aluminum fluoride salt in pores of the anodized surface created by a dissolving attack of fluoride ions on the aluminum oxide coating. Precipitation of dissolved nickel, aluminum, and fluoride ions as the complex salt may be obtained by reducing solubility of the sealing bath, usually by addition of a mixture of simple glycols, such as an ethylene/propylene glycol mixture. The use of nickel unfortunately can lead to problems associated with waste disposal.

Aqueous acidic sealing solutions which contain dissolved potassium hexafluorozirconate and which are applied to anodized aluminum surfaces at elevated temperatures (about 50° C. to about 100° C.) are disclosed in Japanese Patent Publication No. 49-23086. The energy needed to maintain this type of solution at such high temperatures in an unattractive feature of the process described in this Japanese publication.

Indian patent application being Complete Specification No. 150403 discloses aqueous sealing solutions which contain metallic salts of nickel, cobalt and lead or sodium silicate. The addition to such solutions of ethanolamines, metal fluorides, aliphatic amines and aliphatic thioamides is said to provide a sealing solution, the use of which improves the surface appearance of the sealed anodized aluminum surface and reduces the formation of "sealing bloom". The process described in this publication is also burdened by the need to use elevated temperatures, namely temperatures within the range of 65° to 80° C.

The present invention relates to the provision of a sealing process which can be operated effectively at relatively low temperatures and to compositions for use in such low-temperature process.

SUMMARY OF THE INVENTION

In accordance with this invention, there is provided a sealing process based on the use of an aqueous acidic sealing solution which contains as essential ingredients dissolved metal selected from the group consisting of zirconium and titanium and a mixture thereof and dissolved fluoride, and which is effective in treating anodized aluminum surfaces at a temperature of no greater than about 40° C. and preferably at a lower temperature.

The sealing solution for use in the present invention is capable of effectively forming the aforementioned sealed anodized aluminum surface in the absence of materials of the type which create waste disposal problems, including, for example, hexavalent chromium and elements such as manganese, iron, cobalt nickel, molybdenum and tungsten, and also materials such as ferricyanide and ferrocyanide. Accordingly, it is not necessary, to add to the sealing solution materials, which if added, would mandate that effluents comprising the solution be treated specially before the effluent is discharged to the environment or to a sewage disposal plant.

The aqueous acidic fluoride-containing zirconium and/or titanium sealing solutions may further include sealing auxiliaries and/or additives which are capable of enhancing the properties of the sealed anodized coating or improving the conditions under which the solutions are used. Such sealing auxiliaries include polyhydroxy compounds, for example, glycols and lower alkanols. Preferred additives include soluble silicates and/or thiourea compounds.

DETAILED DESCRIPTION OF THE INVENTION

According to the process of the present invention, an anodized aluminum surface is sealed by contacting the surface with a low-temperature aqueous sealing solution containing as essential ingredients dissolved zirconium and/or titanium and fluoride. It is believed that use of the solution promotes formation of a complex aluminum, zirconium, or titanium fluoride sealing coating on the surface and that the reaction mechanism of the present process is comparable to the mechanism of known nickel fluoride sealing processes mentioned above, i.e., that the fluoride ions in the sealing solution attack and dissolve the aluminum oxide coating on the anodized aluminum substrate, and that the resultant aluminum ions, together with fluoride and zirconium or titanium ions are precipitated together as a complex aluminum/(zirconium or titanium)/fluoride salt into the pores of the substrate surface to form a sealing coating. It is contemplated that use of an optional sealing auxiliary may promote formation of the sealing coat, again, presumably by reducing solubility of the sealing solution with respect to the reacting aluminum, fluoride, and zirconium or titanium ions to cause precipitation thereof and formation of the corresponding complex aluminum fluoride sealing coating on the anodized substrate. It is further contemplated that use of the preferred additives, silicates and/or thiourea compounds, impart to the sealed anodized aluminum substrate improved properties, for example, as described in examples hereinbelow. It is ideally desired that the appearance of the sealed coating approach that achieved when anodized aluminum substrates are sealed in hot (100° C.) deionized water which contains, for example, cyclohexanehexacarboxylic acid. It is noted that while hot water-sealed anodized aluminum surfaces have a desirable appearance, they are not as corrosion resistant as surfaces sealed with the solution of the present invention.

Sealing auxiliaries of the type employed in known nickel fluoride sealing processes may be useful, for example, polyhydroxy compounds having from one to about sixteen carbon atoms and which do not interfere with the ability of the sealing solution to seal or provide sealed coatings having the desired corrosion-resistance and appearance. Particularly useful are glycols, and especially a combination of ethylene glycol and propylene glycol. Additional examples of such compounds include lower alkanols, especially $C_{1-16}$ alkanols, and the like. Sealing auxiliaries when present in the sealing bath in an amount of about 25 ml/l to about 100 ml/l yield satisfactory results, 35 ml/l to about 60 ml/l being preferred.

Preferred additives useful in the practice of the present invention include silicates and thiourea compounds soluble in the aqueous acidic sealing solution. As with the sealing auxiliaries, such additives should be present in amounts which do not interfere with the ability of the sealing solutions to seal or provide sealed coatings having the desired corrosion resistance. Particularly useful are alkali metal silicates, for example, potassium silicate, sodium silicate and lithium silicate. In addition, ammonium silicate and alkyl silicates, for example, methyl silicates, may also be used as the source of the silicate in the solution. Thiourea compounds, such as thiourea and lower alkyl derivatives thereof, can be used alone or preferably in admixture with the silicate constituent. Thiourea itself and diethyl thiourea have been used to good advantage.

The amount of silicate (based on $SiO_2$) should be at least about 0.1 g/l and preferably between about 0.3 g/l and about 0.4 g/l. The amount of the thiourea compound should be at least about 0.5 g/l and preferably between about 1.5 g/l and 2.5 g/l. These additives can be used in amounts up to their solubilities, but preferably the amount of silicate (based on $SiO_2$) should not exceed about 0.5 g/l and the amount of the thiourea compound should not exceed about 3 g/l.

The anodized aluminum surface is conveniently sealed by immersing it in an aqueous acidic sealing solution which contains as essential ingredients dissolved zirconium and/or titanium and fluoride. As to the source of the zirconium and/or titanium, there can be used soluble fluozirconate and/or fluotitanate compounds such as, for example, acids (fluozirconic and fluotitanic) thereof and ammonium and alkali metal fluozirconates and fluotitanates. The sealing solution can also be prepared from zirconium fluoride ($ZrF_4$) and/or titanium fluorides ($TiF_3$, $TiF_4$). In addition, the sealing solutions can be prepared from a mixture of soluble compounds, one of which contains zirconium or titanium and the other of which contains fluoride. Examples of such compounds are zirconium nitrate, zirconium sulfate, and titanium (iv) sulfate and hydrofluoric acid and water soluble salts thereof, for example, ammonium and alkali metal salts. Zirconium carbonates such as ammonium and alkali metal zirconium carbonates can also be used.

Satisfactory sealed anodized aluminum surfaces can be formed from sealing solutions containing as little as about 0.18 g/l of either zirconium or titanium, preferably between about 0.2 g/l and about 6 g/l, most preferably between 0.3 and 4 g/l. (When utilizing a mixture of zirconium and titanium, the total of the amounts of zirconium and titanium should be at least about 0.18 g/l.) However, as will be explained below, greater amounts of these ingredients may be required to produce satisfactory coatings depending on other parameters of the coating process.

Zirconium and/or titanium can be used in amounts up to their solubility limits in the acidic aqueous sealing solution. The solubility limits of the ingredients will depend on other parameters of the sealing solution, including particularly, the acidity of the sealing solution and the amount of fluoride in the sealing solution. These parameters should be controlled so that the formation of zirconium and titanium precipitates is avoided. The formation of such precipitate is undesirable for several reasons. Precipitation depletes the amounts of the ingredients. Also, the deposition on the sealed anodized aluminum surface of precipitate can adversely affect the sealing properties. In addition, the formation and accumulation of any type of precipitate can tend to interfere with the application of the sealing solution. If precipitation is encountered in a specific application, the pH of the coating solution may, for example, be lowered, and/or the amount of fluoride can be increased.

Bath solutions having a high concentration of fluoride ion ($[F^-]$) relative to typical $[F^-]$ in prior art $NiF_2$ sealing solutions are generally preferred for applications on conventional anodized aluminum surfaces; fluoride concentrations in the sealing bath of from about 0.2 g/l to about 7 g/l will generally yield adequate results, while fluoride concentrations of from about 0.3 g/l to about 5 g/l will generally yield preferred results. Sealing baths which contain from about 3.5 g/l to about 10.5 g/l $(NH_4)_2ZrF_6$ can be used effectively. The use of deionized water in preparing these baths is preferred. This avoids the presence of extraneous ions.

Generally, the sealing auxiliary and/or other additive is added to the sealing bath prior to immersion of the substrate in the bath. An amount of these additives sufficient to obtain the desired results described supra, is added. The exact amount of these additives is of course dependent on a variety of factors including the source of fluoride employed, its concentration, the additive employed, and the temperature and pH of the solution; factors which affect the solubility of the reacting ions will typically be of particular significance in determining the amount of additives employed in a given bath. In a sealing solution of the type exemplified supra, for example, $(NH_4)_2ZrF_6$ at a concentration of about 5 g/l at 32° C., a suitable auxiliary comprises a mixture of ethylene and propylene glycols in a weight ratio of from about 2:1 to about 1:2, at a concentration of from about 25 ml/l to about 100 ml/l, and preferably about 35 ml/l to about 60 ml/l.

In sealing solutions containing, for example, 0.7 g/l of $H_2ZrF_6$, there can be used at least about 0.5 gl/l of dissolved thiourea and/or at least about 0.1 g/l of dissolved silicate (based on $SiO_2$ content).

As previously noted, the sealing process may be conveniently conducted at ambient (room) temperature, preferably at a temperature of from about 25° C. to about 35° C. In many applications, temperatures of from about 30° C. to about 32° C. will give optimum results. Immersion times of from about 5 to about 10 minutes are generally sufficient to seal surfaces with a coating of good to excellent appearance, although in particular applications, these immersion times can vary by 50% or more for optimum results. Alkaline pH adjustment of the sealing baths is generally not desirable. A pH of about 2 to about 6.5 will generally yield adequate results, while a pH of about 4 to about 6.5 is preferred. For example, a sealing bath prepared with a relatively high concentration of ammonium fluorozirconate and a mixture of ethylene/propylene glycol according to the present invention will have a typical pH of from about 5.25 to about 5.6, more typically about 5.25 to about 5.5, depending on the particular concentration of the salt (see Example I). If the pH of the concentrated sealing solution is increased, as is often done with $NiF_2$ solutions, for example, to 5.8, the solution typically becomes turbid, signifying that the sealing characteristics of the bath having been adversely affected by premature precipitation of the reacting ions. The appearance of the bath just prior to immersion of the substrate is ideally clear, or at most slightly cloudy, and the pH should not be adjusted if a turbid solution will result.

Anodized aluminum surfaces sealed according to the present invention can have a better appearance than anodized aluminum surfaces sealed according to known prior art processes. Sealing times are shorter, typically as short as 5 minutes, and costs of materials are lower. Aluminum or aluminum alloy surfaces anodized according to conventional anodizing processes are generally useful in the process of the invention.

EXAMPLES

The practice of the invention is illustrated by the following Examples.

EXAMPLE I

A. 1100 alloy aluminum panels were subjected to anodizing conditions according to steps 1–9 as follows:

| Step | Treatment Material | Conc. | Temp. | Time (min.) |
|---|---|---|---|---|
| 1. | P3 ALMECO 18 (a) | 50 g/l | about 65° C. | 15 |
| 2. | Rinse: Tap Water | | | |
| 3. | P3 ALMECO 40/NaOH (50%) (b) | 1.2/6.5% | about 65° C. | 7 |
| 4. | Rinse: Tap Water | | | |
| 5. | ANXP-1993 desmut (c) | 10% | Ambient | 2 |
| 6. | Rinse: Tap Water | | | |
| 7. | $H_2SO_4$ | 200 g/l | 18° C. @15 ASF | 40 (19V) |
| 8. | Rinse: Tap Water | | | |
| 9. | P3 ALMECOLOR (d) | — | Ambient | 3⅓ |
| | (component A) | 7% | | @ 16 V |
| | (component B) | 2% | | |
| | (component C) | 1.1% | | |

note:
(a) is a blended powdered cleaner for aluminum containing borax, soda ash, a pyrophosphate, and other ingredients;
(b) is a sequestering composition containing a chlorate salt, sodium hydroxide, water and other ingredients;
(c) is a desmutting composition containing ferric sulfate, inorganic acids and water;
(d) is a three-component electrolytic coloring process final bath containing (after components are mixed) sulfuric acid, tin sulfate, stabilizer and water.

P3, LFN, ALMECO and ALMECOLOR are trademarks of Amchem Products, Inc., Ambler, Pa., 19002, U.S.A.

One panel from each set was left uncolored (Step 9 omitted) in order to perform dye stain tests.

B. Five sealing solutions according to the present invention were prepared by adding $(NH_4)_2ZrF_6$ to deionized water to the following concentrations:

TABLE 1

| Solution | $[(NH_4)_2ZrF_6]$ (g/l) | [Zr] (g/l) | [F] (g/l) |
|---|---|---|---|
| SS1 | 3.5 | 1.27 | 1.63 |
| SS2 | 5.0 | 1.83 | 2.33 |
| SS3 | 7.5 | 2.74 | 3.49 |
| SS4 | 10.5 | 3.65 | 4.65 |
| SS5 | 15.0 | 5.48 | 6.98 |

The pH and appearance of the sealing solutions after addition of 50 ml/l of a 45:55% by weight propylene-/ethylene glycol mixture, (a HENKEL product) to each solution was as follows:

TABLE 2

| Solution | pH (unadjusted) | Appearance |
|---|---|---|
| SS1 | 5.3 | clear |
| SS2 | 5.4 | clear |
| SS3 | 5.4 | clear |
| SS4 | 5.45 | slightly cloudy |
| SS5 | 5.45 | slightly cloudy |

C. The panels anodized according to Example I, part A, were immersed in the five solutions held at a constant temperature of 32° C. for either 5 or 10 minutes, with appearances after water rinsing and air drying as follows:

TABLE 3

| Solution | Panel Designation | Seal Time (min.) | Appearance |
|---|---|---|---|
| SS1 | A1 | 5 | excellent |
| SS1 | A2 | 10 | " |
| SS2 | B1 | 5 | " |
| SS2 | B2 | 10 | " |
| SS3 | C1 | 5 | " |
| SS3 | C2 | 10 | " |
| SS4 | D1 | 5 | " |
| SS4 | D2 | 10 | " |
| SS5 | E1 | 5 | Rainbow at edges |
| SS5 | E2 | 10 | Rainbow and smut |

D. Dye stain and weight loss tests according to ASTM B136-84 and ISO 3210-1974(E) standards, respectively, were performed after 24 hours with the following results:

1. Dye Stain
   All panels in Table 3 passed.
2. Weight Loss
   All panels in Table 3 passed the AAMA 608.1 test standards.

In the examples which follow, sealing solutions according to the present invention were prepared from $H_2ZrF_6$ and deionized water, and the effects of the use of thiourea and/or potassium silicate were evaluated. Panels were anodized according to Example 1, part A., with the exception that in Step 5., ANXP-2193 was used instead of ANXP-1993 (ANXP-2193 contains less iron and is more acidic than ANXP-1993, but is used for the same purpose). The anodized panels were immersed in the solutions for 7 minutes. After water rinsing and air drying, the panels were examined for appearance, and then subjected to the dye-stain test and weight-loss test described above. Small weight loss values are desired. Dye-stain (DST), and weight loss (WLT) testing results, performed after a 24-hour waiting period, are shown for each solution tested in Tables 4–9 below.

EXAMPLE II

In this example, sealing solutions according to the present invention and containing varying concentrations of $H_2ZrF_6$ alone in deionized water were prepared utilizing a 45% solution of $H_2ZrF_6$. The pH of each solution tested was 3.5, and the temperature thereof was maintained at 30° C. Dye-stain and weight-loss tests above described were performed on anodized aluminum test panels. The results appear in Table 4 below.

TABLE 4

Effect of Varying $H_2ZrF_6$ Concentration

| Solution | $H_2ZrF_6$ (g/l) | $H_2ZrF_6$ (M/l) | DST (ASTM B 136-77) | WLT (ISO 3210-1974(E)) (mg/in²) |
|---|---|---|---|---|
| 1 | 0.209 | (0.001) | fail | 19.52 |
| 2 | 0.412 (0.002) | pass | 2.47 | |
| 3 | 0.62 | (0.003) | pass | 2.7 |
| 4 | 0.85 | (0.004) | pass | 2.27 |
| 5 | 1.28 | (0.006) | pass | 2.57 |

Prior to subjecting the sealed panels to the above mentioned tests, there appearances were evaluated. Of the group, the panel treated with Solution 3 had the best appearance. It was given a fair rating.

EXAMPLE III

In this example, there were evaluated sealing solutions containing 0.62 g/l (0.003M/l) of $H_2ZrF_6$ and thiourea in the various amounts indicated in Table 5 below. The pH of the solutions was 5.5 and the temperature thereof was maintained at 30° C. Panels were anodized, immersed, rinsed, dried and tested as described above, and the panels are shown in Table 5 below.

TABLE 5

Effect of Varying Thiourea Concentrations in Solutions Containing 0.62 g/l (0.003 M/l) $H_2ZrF_6$

| Solution | Thiourea (g/l) | Thiourea (M/l) | DST | WLT (mg/in²) |
|---|---|---|---|---|
| 1 | 0.5 | 0.007 | pass | 0.92 |
| 2 | 1.0 | 0.013 | pass | 1.03 |
| 3 | 2.0 | 0.026 | pass | 1.09 |
| 4 | 3.0 | 0.039 | pass | 1.23 |

Prior to subjecting the sealed panels to the above tests, their appearances were evaluated and rated fair.

EXAMPLE IV

In the example which follows, there were evaluated sealing solutions containing 0.62 g/l (0.003 M/l) of $H_2ZrF_6$ and potassium silicate in the various amounts indicated in Table 6 below. The pH of the solutions was 5.5 and the temperature thereof was maintained at 30° C. Anodized panels were prepared and tested as described above the results are shown in Table 6 below.

TABLE 6

Effect of Varying Potassium Silicate Concentrations in Solutions Containing 0.62 g/l (0.003 M/l) $H_2ZrF_6$

| Solution | Potassium Silicate $K_2O$ g/l | Potassium Silicate $SiO_2$ g/l | DST | WLT (mg/in²) |
|---|---|---|---|---|
| 1 | 0.063 | 0.132 | pass | 0.575 |
| 2 | 0.125 | 0.263 | pass | 0.255 |
| 3 | 0.188 | 0.395 | pass | 0.165 |
| 4 | 0.221 | 0.466 | pass | 0.70 |

Prior to subjecting the sealed panels to the above tests, their appearances were evaluated. The appearances of the panels sealed with Solutions 3 and 4 were significatly better than those sealed with Solutions 1 and 2. The appearances of the former were rated good.

EXAMPLE V

In the example which follows, there were evaluated sealing solutions containing 0.62 g/l (0.003 M/l) of $H_2ZrF_6$, 2 g/l (0.026 M/l) of thiourea, and potassium silicate in the various amounts indicated in Table 7 below. The pH of the solutions was 5.5 and the temperature thereof was maintained at 30° C. Anodized panels were prepared and tested as described above and the results are shown in Table 7 below.

TABLE 7

Effect of Varying Potassium Silicate Concentrations in Solutions Containing 0.62 g/l (0.003 M/l) $H_2ZrF_6$ and 0.026 M/l Thiourea

| Solution | Potassium Silicate $K_2O$ g/l | Potassium Silicate $SiO_2$ g/l | DST | WLT (mg/in²) |
|---|---|---|---|---|
| 1 | 0.063 | 0.132 | pass | 0.76 |
| 2 | 0.125 | 0.263 | pass | 0.55 |
| 3 | 0.188 | 0.395 | pass | 1.0 |
| 4 | 0.221 | 0.466 | pass | 0.12 |

Prior to subjecting the sealed panels to the above tests, their appearances were evaluated. The appearance of the panel sealed with Solution 4 was significantly better than those sealed with Solutions 1 to 3. The appearance of the former was rated good.

EXAMPLE VI

In the example which follows, there were evaluated solutions containing 0.68 g/l of $H_2ZrF_6$, 2 g/l thiourea and potassium silicate in an amount equivalent to 0.221 g/l of $K_2O$ and to 0.466 g/l of $SiO_2$ (preferred amounts from Examples II–V above). The temperature of the solutions was maintained at 30° C. and the pH varied, as indicated in Table 8 below, utilizing appropriate amounts of an aqueous solution of ammonia. Anodized panels were prepared and tested as described above and the results are shown in Table 8 below.

TABLE 8

Effect of Varying pH in Preferred Solutions Containing 0.68 g/l $H_2ZrF_6$, 2 g/l Thiourea, And Indicated Amount of Potassium Silicate

| Solution | pH | DST | WLT (mg/in²) |
|---|---|---|---|
| 1 | 4.0 | pass | 0.78 |
| 2 | 5.0 | pass | 0.42 |
| 3 | 5.5 | pass | 0.81 |
| 4 | 6.0 | pass | 0.315 |
| 5 | 6.5 | pass | 1.055 |
| 6 | 7.0 | fail | 16.53 |

Examination of the sealed panels prior to testing revealed that the appearance of the panels sealed with Solutions 4 to 5 were excellent whereas those sealed with Solutions 1 to 3 were not particularly good.

EXAMPLE VII

In the example which follows, preferred sealing solutions having the same ingredients and concentrations as in Example VI above were prepared. The pH of each solution was 6.0 (a preferred pH for Example VI above) and the temperature varied as shown in Table 9 below. Anodized panels were prepared and tested as described above and the results shown in Table 9 below.

TABLE 9

Effect of Varying Temperature at pH 6.0 on Preferred Solutions (0.68 g/l $H_2ZrF_6$, 2 g/l Thiourea and Indicated Amount of Potassium Silicate)

| Solution | Temp. °C. | DST | WLT (mg/in$^2$) |
|---|---|---|---|
| 1 | 25 | pass | 0.82 |
| 2 | 30 | pass | 0.77 |
| 3 | 35 | pass | 0.25 |
| 4 | 40 | pass | 0.115 |

Examination of the sealed panels prior to testing revealed that the appearances of the panels sealed at 25° C. and 30° C. were excellent, whereas those sealed at 35° C. and 40° C. were fair.

EXAMPLE VIII

In this example, it was determined that like concentrations of diethylthiourea could be substituted effectively for thiourea in the preferred sealing solutions described above.

In summary, it can be said that in accordance with the present invention, there can be produced sealed anodized coatings having excellent functional and aesthetic properties and that such coatings can be produced under conditions which involve the use of relatively low temperatures.

We claim:

1. A method for sealing an anodized aluminum surface comprising contacting said surface at a temperature of no greater than about 40° C. with an aqueous acidic sealing solution having a pH of about 2 to about 6.5 and comprising at least about 0.18 g/l of dissolved metal selected from the group consisting of zirconium and titanium and a mixture thereof, at least about 0.2 g/l of dissolved fluoride and at least about 0.1 g/l of dissolved silicate (based on $SiO_2$ content).

2. A method according to claim 1 wherein said solution further comprises a sealing auxiliary.

3. A method according to claim 2 wherein said surface is reacted with said dissolved metal and said fluoride, and said auxiliary is a water-miscible organic solvent which decreases the solubility of said reactants in said solution sufficiently to promote formation of a complex aluminum fluoride sealing coating.

4. A method according to claim 3 wherein said auxiliary is a glycol, a lower alkanol, or any mixture thereof.

5. A method according to claim 4 wherein said auxiliary is a mixture of glycols comprising ethylene and propylene glycol.

6. A method according to claim 5 wherein said ethylene and propylene glycols are present in a proportion of from about 2:1 to about 1:2 by volume.

7. A method according to claim 1 in which the amount of said silicate does not exceed about 0.5 g/l.

8. A method according to claim 1 wherein the source of said silicate is an alkali metal silicate.

9. A method according to claim 1 wherein the source of said zirconium and fluoride includes an alkali metal or ammonium fluozirconate.

10. A method according to claim 9 wherein said solution includes about 3.5 to about 15 g/l of ammonium fluozirconate.

11. A method according to claim 1 wherein the pH of said solution is about 5.25 to about 5.5.

12. A method according to claim 1 wherein said solution consists essentially of a soluble fluozirconate or fluotitanate salt, at least about 0.5 g/l of a dissolved thiourea compound, a sealing auxiliary, and deionized water.

13. A method according to claim 1 wherein said temperature is about 25° to about 35° C.

14. A method according to claim 13 wherein said temperature is about 30° to 32° C.

15. A method according to claim 1 wherein the amount of said dissolved metal is about 0.2 to about 6 g/l and wherein said solution includes a dissolved thiourea ompound in an amount of about 1.5 to about 3 g/l.

16. A method according to claim 15 wherein the amount of said dissolved metal is about 0.3 to about 4 g/l and the amount of said thiourea compound is about 1.5 to about 2.5 g/l.

17. A method according to claim 1 wherein said solution further comprises at least about 0.5 g/l of a dissolved thiourea compound or a mixture of said silicate and said thiourea.

18. A method according to claim 2 wherein the amount of said auxiliary is at least about 25 ml/l.

19. A method according to claim 1 in which the amount of said fluoride is about 0.2 to about 7 g/l.

20. A method according to claim 19 in which the amount of said fluoride is about 1.6 to about 5 g/l.

21. A method according to claim 1 wherein the source of said zirconium and said fluoride includes fluozirconic acid and including also potassium silicate.

22. A method according to claim 1 wherein the amount of said dissolved metal is about 0.2 to about 6 g/l and wherein said solution includes a dissolved thiourea compound in an amount of about 1.5 to about 3 g/l and said silicate compound in an amount of about 0.3 to about 0.5 g/l.

23. A method according to claim 22 wherein the amount of said dissolved metal is about 0.3 to about 4 g/l and the amount of said silicate is about 0.3 to about 0.4 g/l.

24. A method according to claim 1 wherein the pH is about 4 to about 6.5.

25. A method according to claim 1 wherein said solution is substantially free of materials which create waste disposal problems, including hexavalent chromium, manganese, iron, cobalt, nickel, molybdenum, tungsten, ferricyanide or ferrocyanide.

26. A method according to claim 8 wherein said solution is substantially free of materials which create waste disposal problems, including hexavalent chromium, manganese, iron, cobalt, nickel, molybdenum, tungsten, ferricyanide or ferrocyanide.

27. A method according to claim 15 wherein said solution is substantially free of materials which create waste disposal problems, including hexavalent chromium, manganese, iron, cobalt, nickel, molybdenum, tungsten, ferricyanide or ferrocyanide.

28. A method according to claim 19 wherein said solution is substantially free of materials which create waste disposal problems, including hexavalent chromium, manganese, iron, cobalt, nickel, molybdenum, tungsten, ferricyanide or ferrocyanide.

29. A method according to claim 22 wherein said solution is substantially free of materials which create waste disposal problems, including hexavalent chromium, manganese, iron, cobalt, nickel molybdenum, tungsten, ferricyanide or ferrocyanide.

* * * * *